US005580025A

United States Patent [19]

Cross

[11] Patent Number: 5,580,025

[45] Date of Patent: Dec. 3, 1996

[54] DISHWASHER RETAINING DEVICE

[76] Inventor: Robert Cross, N55 W30659 Hwy. K, Hartland, Wis. 53029

[21] Appl. No.: 468,080

[22] Filed: Jun. 6, 1995

[51] Int. Cl.[6] ..... A47B 97/00

[52] U.S. Cl. ..... 248/507; 211/41; 211/181

[58] Field of Search ..... 211/41, 74, 181, 211/183; 248/507, 509; 220/487, 488

[56] References Cited

U.S. PATENT DOCUMENTS 1,165,840 12/1915 Brutus ..... 211/74 X 3,289,854 12/1966 Kauffman ..... 211/41

4,927,033 5/1990 Patera et al. ..... 211/41

5,249,590 10/1993 Jacobus et al. ..... 211/41 X

*Primary Examiner*—Kenneth J. Dorner

*Assistant Examiner*—Jerry Redman

*Attorney, Agent, or Firm*—Joseph S. Heino

[57] ABSTRACT

A resilient retaining device includes a base member which is adapted to engage and removably attach itself to a dishwasher rack prong and has extending from it a shaft and hook portion. The hook portion releasably engages and retains a cup or article with slight pressure.

2 Claims, 1 Drawing Sheet

DISHWASHER RETAINING DEVICE

FIELD OF THE INVENTION

This invention relates generally to retention devices. More particularly, it relates to a retaining device for removably securing cups and the like within the rack of a dishwasher.

BACKGROUND OF THE INVENTION

A commonly recognized problem associated with washing cups and the like in an automatic dishwasher is that cups and cup-shaped articles placed within the dishwasher racks often have a tendency to shift and tip over during the wash cycle. Regardless of the cause of such movement, it is not desirable. Cups and the like which are tipped over during the wash cycle will, quite obviously, collect water and other debris which is normally intended to be washed away. In the case of fine china and other fragile dinnerware, such shifting can result in chipping and even breaking of the pieces.

Some prior devices have attempted to deal with these problems by providing article holders to retain the cups and the like in a fixed position within the dishwasher rack. For example, U.S. Pat. No. 3,289,854 to Kauffman illustrates an article retaining device in the form of a clip which secures one side of a cup to a dishwasher rack prong. Similarly, U.S. Pat. No. 4,927,033 to Patera et al shows another removable article holder in the form of a curvilinear biasing member which is intended to be attached to a horizontally extending tine of the dish rack. Both of these prior devices accomplish the holding of the cups by utilizing contact points within the cup which is begin held.

It is, in the experience of this inventor, advantageous to avoid the securing of any cups or the like by using contact points within the cup. Such contact points tend to create a "trap" for dishwasher debris and soap. Such a trap can create just as undesirable of a cleaning result as an overturned cup will. That is, any point-to-point contact within the cup is to be avoided.

SUMMARY OF THE INVENTION

It is, therefore, a principal object of this invention to provide a new, useful and uncomplicated device for securing a cup or the like within a dishwasher rack which eliminates any contact point within the cup and which minimizes the size of the external contact point thereby realizing maximum sanitation of cups. It is another object of this invention to provide such a device which requires only a minimal number of elements and which requires only a minimal number of steps to utilize. It is still another object to provide such a device which can be used with most commercially available dishwashers and which is adjustable so as to be capable of washing cups of different sizes. It is yet another object to provide such a device which can be easily removed from the dishwasher rack and which will not, under use or non-use conditions, become dislodged from the dishwasher rack and fall into the bottom of the dishwasher and thereby become difficult to retrieve or come into contact with the dryer elements.

The present invention has obtained these objects. It provides for a resilient retaining device which is removably attachable to a dishwasher rack prong. The retaining device has a base which is functionally adapted to engage a dishwasher rack prong. From the base extends a resilient shaft and a hook portion. The hook portion is intended to engage the cup to be held under slight pressure from the shaft. The base is removably attached to the prong to firmly hold the cup in place. The foregoing and other features of the device of the present invention will be further apparent from the description which follows.

DETAILED DESCRIPTION

Figure 1:
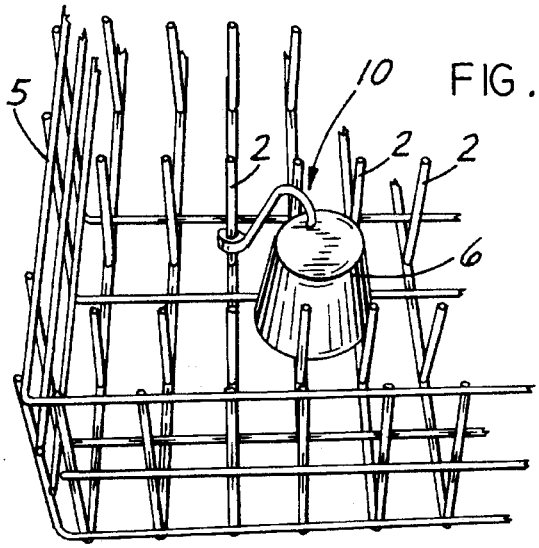
FIG. 1 is a perspective view showing a portion of a typical dishwasher rack and also showing the retaining device of the present invention attached to one prong of the rack.
Figure 2:
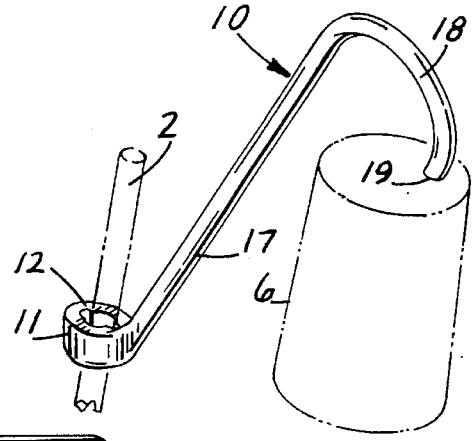
FIG. 2 is an enlarged perspective view of the retaining device shown in FIG. 1.
Figure 3:
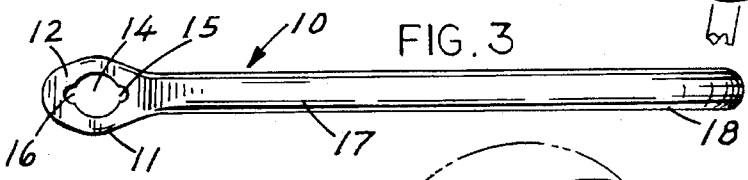
FIG. 3 is a further enlarged top plan view of the retaining device shown in FIG. 2.
Figure 4:
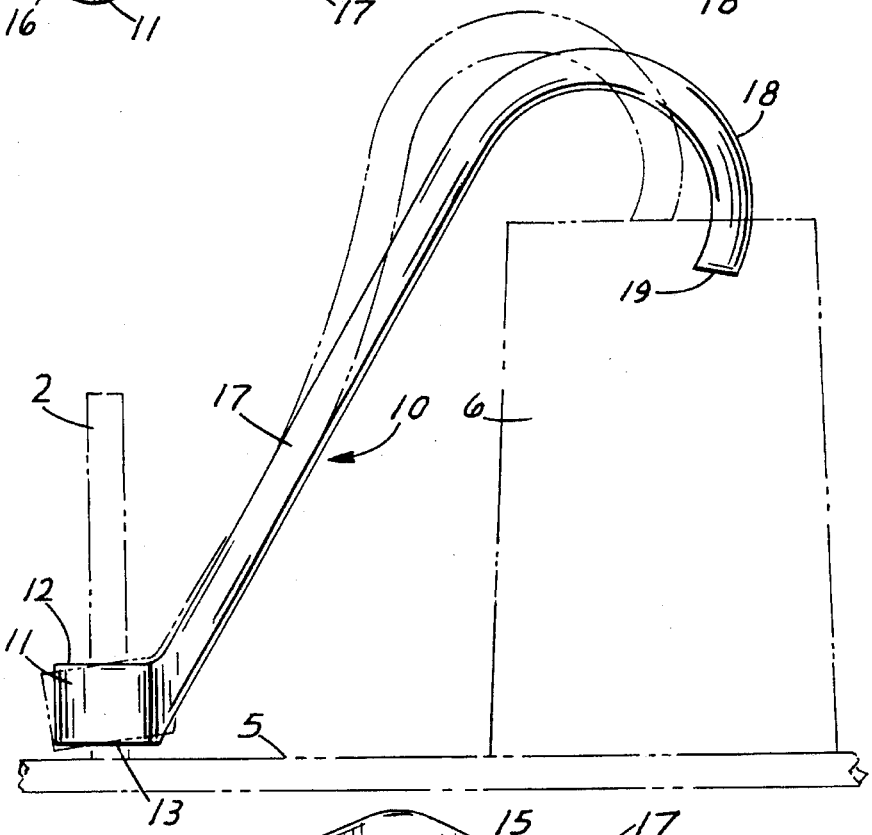
FIG. 4 is a still further enlarged left side elevational view of the retaining device shown in FIG. 1.
Figure 5:
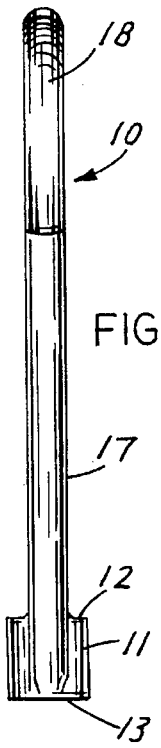
FIG. 5 is a front elevational view of the retaining device shown in FIG. 3.
Figure 6:
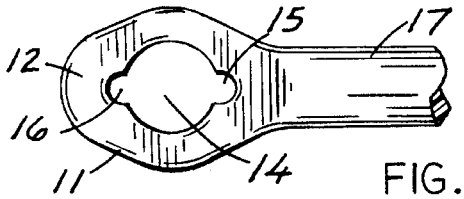
FIG. 6 is an enlarged top plan view showing the details of the base portion of the retaining device.

Referring now to the drawings in detail, FIG. 1 shows a dishwasher retaining device, generally identified 10, constructed in accordance with the device of the present invention. As shown, the retaining device 10 is functionally adapted to be attached to any one of the many prongs 2 of a dishwasher rack 5. It is also adapted to releasably secure a cup 6 placed within the rack 5.

The retaining device 10 has a base 11 from which extends an upwardly projecting shaft 17. At the opposite end of the shaft 17 is a hook portion 18. See FIGS. 2 through 6. In the preferred embodiment, the base 11, shaft 17 and hook portion 18 are formed from a single piece of thermoplastic injection molded polypropolene-type material. It is to be understood that the retaining device 10 may be molded or formed from one of several commercially available and resilient materials having mold or form "memory", the significance of which will become more apparent later in this detailed description.

The base 11 of the retaining device 10 has a generally flat top surface 12 and a generally flat bottom surface 13 between which extends a generally vertical and circular base aperture 14. To one side of the aperture 14, and, in particular, the side closest to where the shaft 17 projects from the base 11, extends a first generally vertical semi-circular groove 15 defined within the outer surface of the aperture 14. See FIG. 6. A second generally vertical semi-circular groove 16 is defined within the outer surface of the aperture 14 and which is opposite the first groove 15. The significance of these opposing grooves 15, 16 will likewise become apparent later in this detailed description.

In application, the user places the retaining device 10 such that the base 11 is downward in relation to the hook portion 18 of the retaining device 10. The base aperture 14 is then aligned with a prong 2 of the dishwasher rack 5 at or near the cup 6 which is to be held in place. The base 11 is passed over the end of the prong 2. It should be noted that, as an important feature of the preferred embodiment, the circular base aperture 14 is functionally adapted to accept and pass over the prongs of any number of commercially available automatic dishwasher racks. In this position, the base 11 is moved downwardly along the prong 2 to the point that the distal end 19 of the hook 18 comes into contact with the bottom surface of the upside-down cup 6. The base 11 is then urged downwardly such that the base 11 becomes slightly cocked.

With this movement, two things happen. First, the shaft 17 of the retaining device 10 becomes flexed and gently puts pressure on the cup 6 at the point of the distal hook end 19. This results in slight deformation of the shaft 17. It also results in the firm holding of the cup 6 in place. Secondly, the prong 2, which generally comprises a vinyl coated metal rod, is grasped by the first aperture groove 15 at or near the base top surface 12 and by the second aperture groove 16 at or near the base bottom surface 13. This results, more or less, in the base 11 "locking on" to the prong vinyl and prevents movement of the base 11 during the washing cycle.

To remove the retaining device 10 from the prong 2, the hook 18 and the shaft 17 are flexed sufficiently to remove the cup 6 from under the distal hook end 19. With the cup 6 removed, the retaining device 10 will "relax" thereby allowing the base 11 to be cocked back and releasing the prong 2 from the base aperture grooves 15, 16. The retaining device 10 may then be removed from the prong 2 or left on it for use during the next wash cycle. With the retaining device 10 slidably attached to the prong 2, the user need not worry about the retaining device 10 falling off into the bottom of the washer thereby making it difficult to retrieve or exposing it to dryer elements.

From the foregoing detailed description of the illustrated embodiment of the invention set forth herein, it will be apparent that there has been provided a new, useful and uncomplicated device for securing a cup or the like within a dishwasher rack; which eliminates any contact point within the cup; which minimizes the size of the external contact point and thereby realizes maximum sanitation of cups; which requires only a minimal number of elements; which requires only a minimal number of steps to utilize; which can be used with most commercially available dishwashers; which is adjustable so as to be capable of washing cups of different sizes; which can be easily removed from the dishwasher rack; and which will not, under use or non-use conditions, become dislodged from the dishwasher rack and fall into the bottom of the dishwasher and thereby become difficult to retrieve or come into contact with the dryer elements.

The principles of this invention having been fully explained in connection with the foregoing, I hereby claim as my invention:

1. A retaining device in combination with a dishwasher rack for securing a generally cup-shaped article within said dishwasher rack, said dishwasher rack having at least one generally vertically extending and vinyl coated prong, said retaining device comprising a base member, said base member including a generally circular and vertically extending aperture having a surface defined within said base member for receiving said vertically extending vinyl coated prong, means for removably attaching the base member to said vertically extending vinyl coated prong, said base member prong attachment means including a pair of opposing grooves further defined within the surface of said base member aperture, said grooves being functionally adapted to releasably engage the vinyl coated prong, a shaft member, said shaft member having a distal end and a proximal end and being attached at its proximal end to said base member and extending generally upwardly from said base member, and a retention member, said retention member being attached to said shaft member distal end and being functionally adapted to releasably secure a cup-shaped article within the dishwasher rack, said retention member, shaft member and base member being integrally formed of a resilient material.

2. A retaining device in combination with a dishwasher rack for securing a generally cup-shaped article within said dishwasher rack, said dishwasher rack having at least one generally vertically extending and vinyl coated prong, said retaining device comprising a base member, said base member including a generally circular and vertically extending aperture having a surface defined within said base member, means for removably attaching the base member to said vertically extending vinyl coated prong, said base member prong attachment means including a pair of opposing grooves further defined within the surface of said base member aperture, said grooves being functionally adapted to releasably engage the vertically extending vinyl coated prong, means for retaining said cup-shaped article, and means interposed between said base member and said retaining means for biasing said retaining means towards said cup-shaped article so as to exert generally downwardly directed force on said cup-shaped article, said base member, said retention means and said biasing means being integrally formed of a resilient material.

* * * * *